US006527124B1

(12) United States Patent
Nakhei-Nejad

(10) Patent No.: US 6,527,124 B1
(45) Date of Patent: Mar. 4, 2003

(54) PISTACHIO BLANKS SEPARATOR

(76) Inventor: Mohammad Nakhei-Nejad, #402, 10721 Saskatchewan Drive, Edmonton (CA), T6E 6J5

( * ) Notice: Subject to any disclaimer, the term of this patent is extended or adjusted under 35 U.S.C. 154(b) by 205 days.

(21) Appl. No.: 09/847,295

(22) Filed: May 3, 2001

(51) Int. Cl.[7] ..... B03B 5/28

(52) U.S. Cl. ..... 209/173; 209/172; 209/172.25; 209/490; 209/493

(58) Field of Search ..... 209/173, 172, 209/172.25, 493, 490

(56) References Cited

U.S. PATENT DOCUMENTS 3,962,072 A * 6/1976 Ramacher et al. ..... 209/140
4,927,030 A * 5/1990 Chastain et al. ..... 209/620
5,087,351 A * 2/1992 Valentine, Sr. ..... 209/20
5,467,700 A * 11/1995 Dowell et al. ..... 209/19

* cited by examiner

*Primary Examiner*—Donald P. Walsh
*Assistant Examiner*—Jonathan R. Miller
(74) *Attorney, Agent, or Firm*—Bennett Jones LLP

(57) ABSTRACT

An apparatus for separating blank pistachio shells and other debris from pistachio nuts includes a flotation tank, a weir and discharge channel, a conveyor within the flotation tank and a pair of counter-rotating rollers for squeezing floating items and for urging floating items towards the weir and discharge channel.

12 Claims, 3 Drawing Sheets

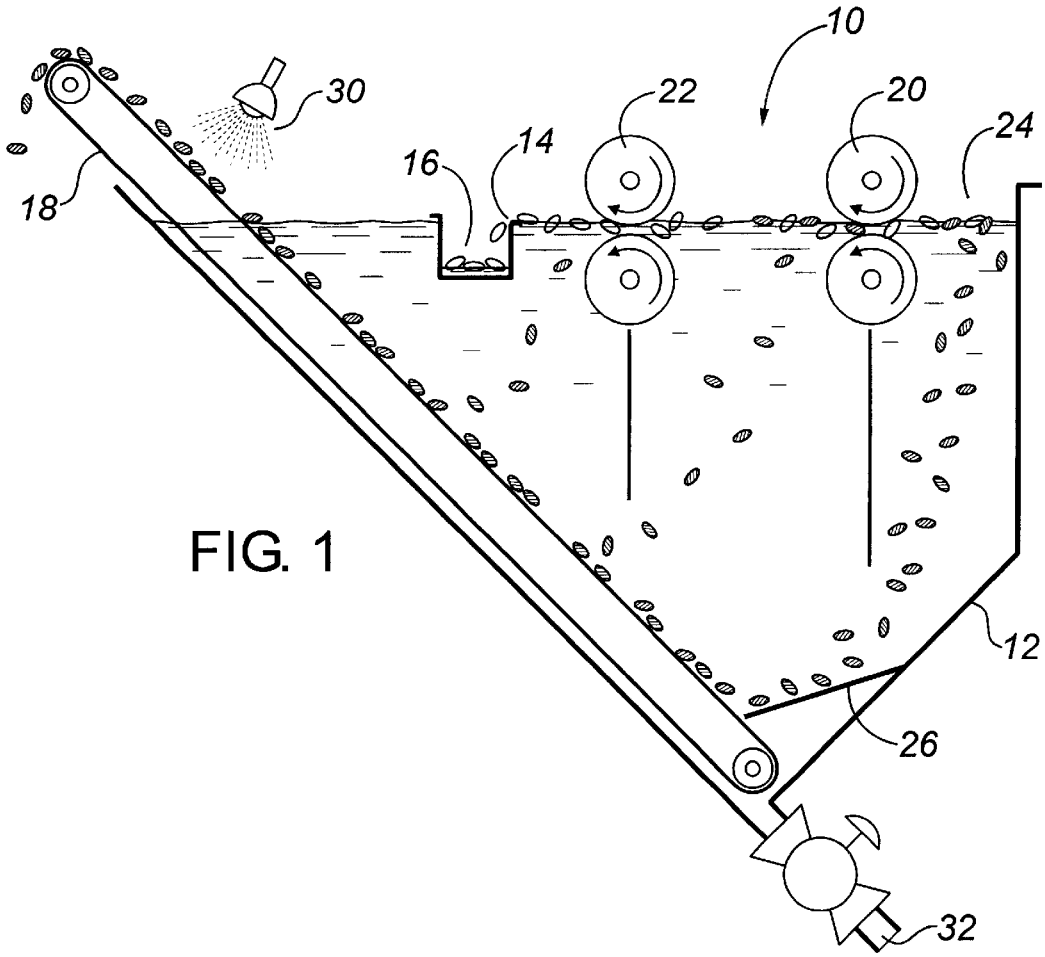
FIG. 1
FIG. 2
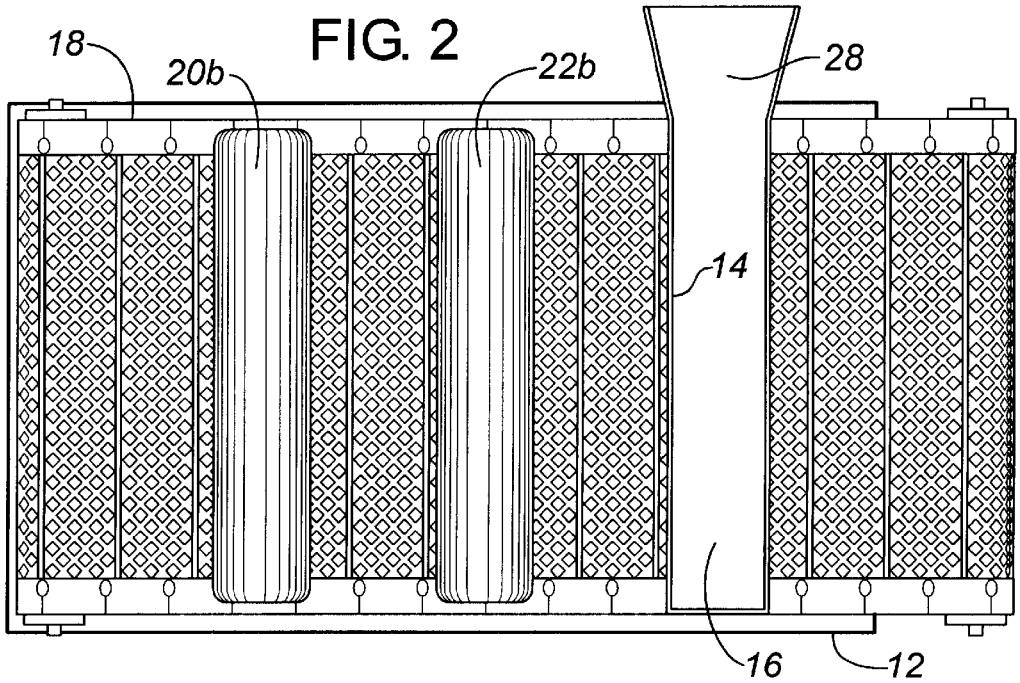

PISTACHIO BLANKS SEPARATOR

FIELD OF THE INVENTION

The present invention relates to an apparatus for separating blank pistachio shells from intact pistachio nuts.

BACKGROUND OF THE INVENTION

Pistachio nuts have a hard shell around the edible kernel and a pericarp or hull which encases the shell. It is necessary to mechanically hull pistachios in order to process commercial quantities of the nut. Ripe pistachios shells are split prior to processing and the nut within the shell may be lost during processing, resulting in a number of blank shells. Pistachios which are not fully ripe may be closed. Many closed shell pistachios have an incompletely formed kernel inside, referred to as "blanks". Some pistachios in which the shell has split early may have been damaged by exposure to the elements, fungal contamination or by insect damage. Furthermore, twigs, branches and other debris may be included with the pistachios.

It is a laborious job to manually remove the blank shells, blanks, damaged pistachios and other unwanted debris from the good pistachio nuts. Therefore, there is a need in the art for an automated process and system for separating and removing blank pistachio shells, blanks, damagaed pistachios and other debris during the processing of pistachio nuts.

SUMMARY OF THE INVENTION

In general term, the invention provides a method and apparatus for separating and removing blank pistachio shells, blanks, damaged pistachios and other debris. The pistachios are deposited in a flotation tank filled with water to a controlled level. A weir skims the surface of the water and gathers objects which are floating. The weir leads to a discharge channel. At least one pair of counter-rotating rollers are approximately level with the weir and the water surface. The rollers squeeze the floating objects and urge them towards the weir. Blank pistachio shells, blanks, damaged pistachios and other debris tend to float. Good pistachios tend to sink and deposit on the bottom of the flotation tank. A conveyor or equivalent means removes the good pistachios from the tank for further processing. Some good pistachios float as a result of air bubbles trapped within the pistachio shell. The squeezing action of the rollers tends to free the air bubbles, causing such good pistachios to sink.

Therefore, in one aspect, the invention comprises an apparatus for separating floating items from good pistachio nuts comprising:

(a) a flotation tank having an inclined bottom;

(b) a conveyor disposed along the inclined bottom of the flotation tank for removing pistachio nuts from the bottom of the flotation tank;

(c) a weir and discharge channel for skimming and removing floating items from the surface of water held in the flotation tank; and (d) at least one pair of counter-rotating horizontal rollers associated with the tank, wherein an upper roller is disposed above a lower roller and an interface between the upper and lower rollers is substantially level with the weir.

In another aspect, the invention may comprise an apparatus for separating good pistachio nuts from floating items comprising:

(a) a flotation tank;

(b) a weir and discharge channel for skimming floating debris from the flotation tank;

(c) roller means for squeezing floating items and urging floating items towards the weir and discharge channel; and (d) means for removing good pistachio nuts from the bottom of the flotation tank.

In another aspect, the invention may comprise a method of separating pistachio nuts from floating items comprising the steps of:

(a) providing a flotation tank filled with water;

(b) providing a weir and discharge channel for skimming floating items from the flotation tank;

(c) squeezing floating items between two counter-rotating rollers; and (d) collecting pistachio nuts from the bottom of the flotation tank.

BRIEF DESCRIPTION OF THE DRAWINGS

The invention will now be described by way of an exemplary embodiment with reference to the accompanying simplified, diagrammatic, not-to-scale drawings. In the drawings:

FIG. 1 is a schematic representation of one embodiment of the invention, shown in longitudinal cross-section.

FIG. 2 is a top view of the embodiment shown in FIG. 1;

DETAILED DESCRIPTION OF THE INVENTION

Figure 3:
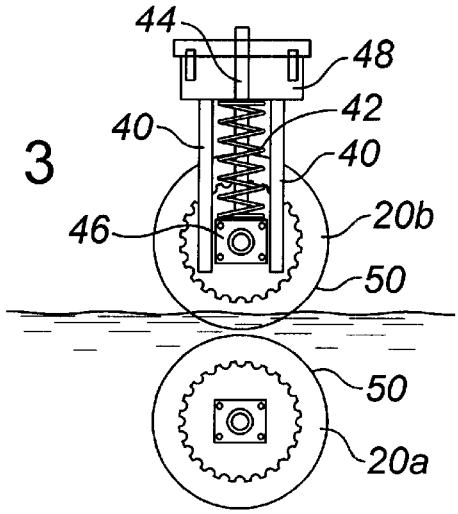
FIG. 3 is a cross-sectional view of one pair of rollers.

The present invention provides for an apparatus which separates blank pistachios and other debris from good pistachios. As used herein, "good pistachios" means pistachios which are completely or substantially hulled and have a complete kernel contained within the pistachio shell. As used herein, "floating items" refers to all items mixed with good pistachios which float in water and may include blank open pistachio shells, blank closed pistachios, damaged pistachios and debris such as twigs and branches. When describing the present invention all terms not defined herein have their common art-recognized meanings. The following detailed description is of a specific embodiment of the invention, which is not to be limiting of the claimed invention.

The apparatus (10) shown in the Figures comprises primarily of a flotation tank (12), a weir (14), a discharge channel (16), a conveyor (18) and two pairs of counter-rotating rollers (20 and 22).

The pistachios to be processed have been hulled and washed. The pistachios are deposited into the flotation tank at the inlet end (24) of the flotation tank (12). As stated above, good pistachios tend to sink and are directed towards the conveyor (18) by the inclination of the flotation tank and a sloped deflector (26) at the bottom of the tank. Floating items pass between the first pair of rollers (20). The rollers (20) are covered with a relatively soft resilient material such as a rubber, elastomer or plastic. The rollers squeeze the floating items and urge them towards the second pair of rollers (22). The squeezing action may release air bubbles trapped in good pistachios, causing the good pistachio to sink towards the bottom and the conveyor (18). Item which remain floating will then pass to the second pair of rollers (22) which are identical to the first pair (20). Again, any remaining floating good pistachios are squeezed to remove residual air bubbles, which then sink. Items which remain floating are urged towards the weir (14). Items which pass over the weir are deposited into the discharge channel (16) which runs laterally across the tank (12). In one embodiment, the height of the weir may be adjustable by means of a lip which slides vertically along a support rail. In one embodiment, the discharge channel (16) is inclined slightly from side to side in order to cause water and floating debris to run off to one side and out an outlet (28).

In one embodiment, the good pistachios emerging from the tank on the conveyor are sprayed with fresh water from a sprayer (30) to clean and rinse the pistachios and the spray water is directed into the tank to replenish the water which is lost in the discharge channel. A drain outlet (32) is also provided to release water from the tank (12) if necessary.

The roller pairs (20, 22) are postioned so that the interface between the upper and lower rollers is just slightly below the water surface. As a result, all floating items that approach the rollers will be drawn between the rollers. In one embodiment, as shown in FIG. 3, the lower roller (20*a*) is fixed in position while the upper roller (20*b*) may move vertically in response to larger items passing between the rollers. The upper roller may move along vertical rails (40) while a spring (42) biases the roller to its lowest position. The spring (42) is positioned on a shaft (44) which extends vertically upward from the bearing assembly (46) on both sides of the roller. The force imparted by the spring (42) may be adjusted by adjusting the position of a top plate (48) to increase or decrease the precompression of the spring (42).

Figure 4:
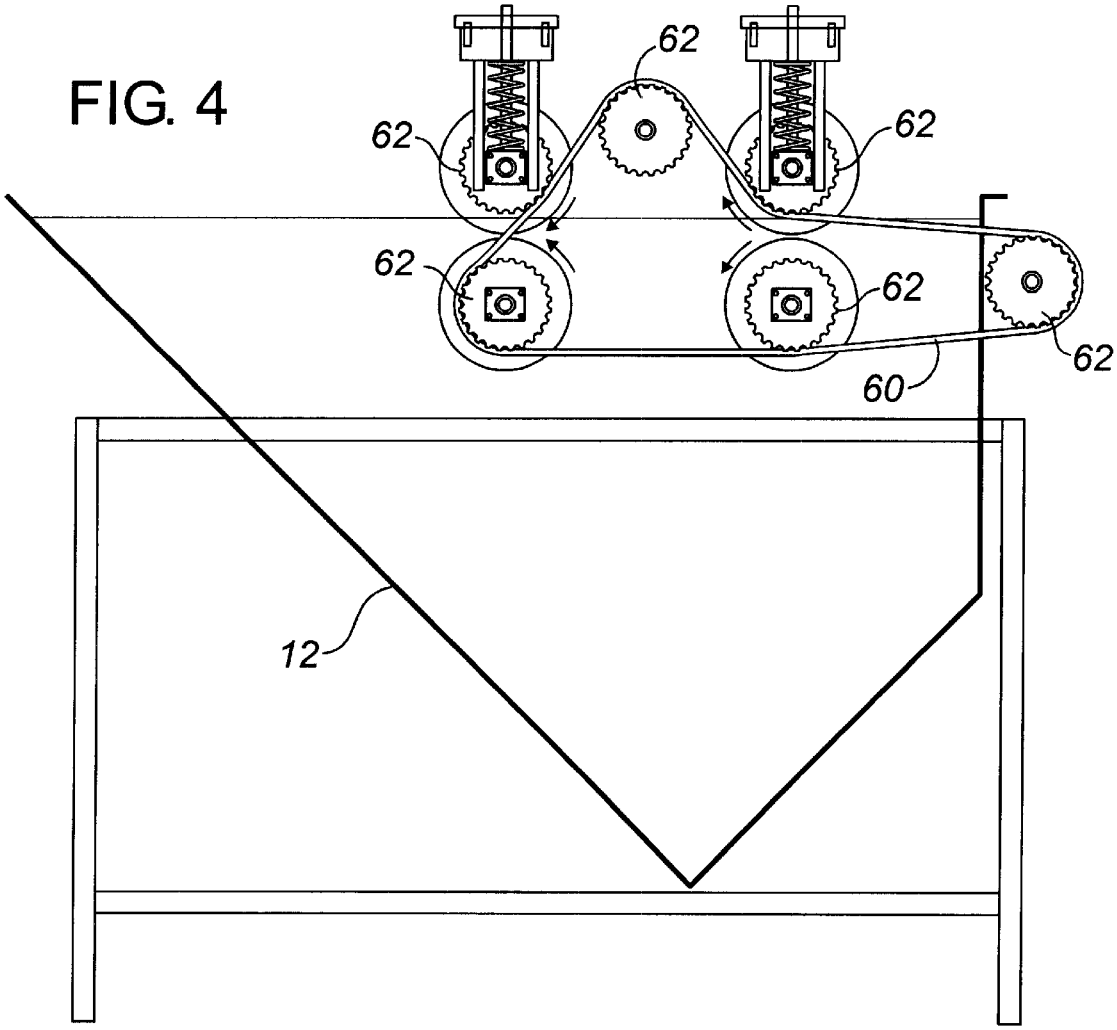
FIG. 4 is a side view of the drive mechanism of the rollers.

The resilient cover material (50) on the rollers should preferably be hard enough to manipulate the pistachios but not so hard as to damage the pistachios. In one embodiment, the cover material (50) is a relatively soft rubber material. The rollers are driven by a chain drive (60) and sprockets (62) as is shown in FIG. 4.

Figure 5:
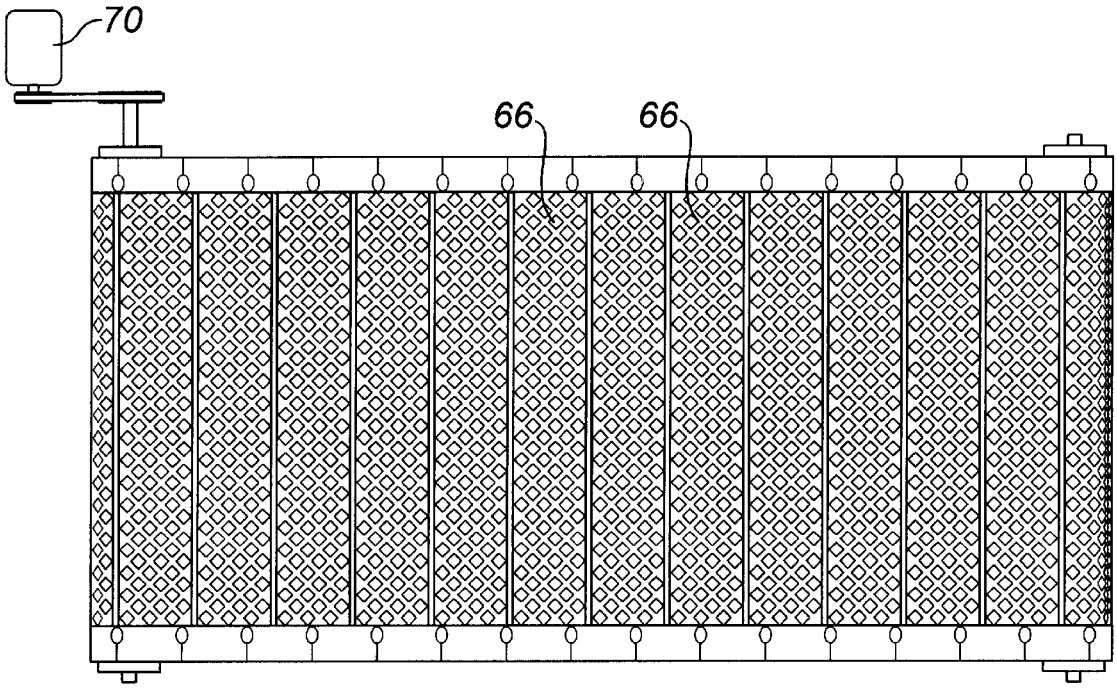
FIG. 5 is a top view of one embodiment of a conveyor.
Figure 5A:
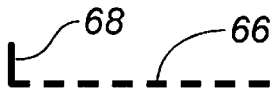
FIG. 5A shows a cross-sectional view of one segment of the conveyor.

In one embodiment, the bottom of the tank (12) is V-shaped when viewed in longitudinal cross-section, as shown in FIG. 1. The conveyor (18) runs up one side of the tank to remove good pistachios from the tank. The conveyor may be a belt or tray conveyor. In one embodiment, the conveyor is formed from a plurality of slotted metal L-shaped segments (66) which are hinged together to form a continuous conveyor. The slots permit water to drain quickly from the conveyor. The upright portion (68) of the L-shaped segment catches the good pistachios as shown in FIG. 5A. The conveyor (18) may be driven by an electric motor (70) as is conventional in the art.

As will be apparent to those skilled in the art, various modifications, adaptations and variations of the foregoing specific disclosure can be made without departing from the scope of the invention claimed herein.

What is claimed is:

1. An apparatus for separating floating items from good pistachio nuts comprising:

(a) a flotation tank having an inclined bottom;

(b) a conveyor disposed along the inclined bottom of the flotation tank for removing pistachio nuts from the bottom of the flotation tank;

(c) a weir and discharge channel for skimming and removing blank pistachio shells and floating debris from the surface of water held in the flotation tank; and (d) at least one pair of counter-rotating horizontal rollers associated with the tank, wherein an upper roller is disposed above a lower roller and an interface between the upper and lower rollers is substantially level with the weir.

2. The apparatus of claim 1 wherein the at least one pair of counter-rotating rollers urges floating debris towards the weir and discharge channel.

3. The apparatus of claim 1 comprising two pairs of counter-rotating rollers, wherein a first pair of rollers urges floating items towards a second pair of rollers and the second pair of rollers urges floating items towards the weir and discharge channel.

4. The apparatus of claim 1 further comprising water spray means for directing fresh water at pistachio nuts emerging from the flotation tank on the conveyor.

5. The apparatus of claim 1 wherein the discharge channel is oriented parallel to the rollers and is inclined from side to side.

6. The apparatus of claim 1 wherein at least one roller of each pair of rollers is vertically moveable.

7. The apparatus of claim 6 further comprising biasing means for biasing the moveable roller towards the other roller.

8. The apparatus claim 1 wherein the height of the weir is adjustable.

9. An apparatus for separating good pistachio nuts from floating items comprising:

(a) a flotation tank;

(b) a weir and discharge channel for skimming floating debris from the flotation tank;

(c) roller means for squeezing floating debris and urging floating debris towards the weir and discharge channel; and (d) means for removing pistachio nuts from the bottom of the flotation tank.

10. A method of separating good pistachio nuts from floating items comprising the steps of:

(a) providing a flotation tank filled with water;

(b) providing a weir and discharge channel for skimming floating debris from the flotation tank;

(c) squeezing floating debris between two counter-rotating rollers; and (d) collecting pistachio nuts from the bottom of the flotation tank.

11. The method of claim 10 wherein there are provided two pairs of counter-rotating rollers, wherein a first pair of rollers urges floating debris towards a second pair of rollers and the second pair of rollers urges floating debris towards the weir and discharge channel.

12. The method of claim 10 wherein the pistachio nuts are collected from the flotation tank by means of an inclined continuous conveyor.

* * * * *